US009352922B2

(12) United States Patent
Kuwana et al.

(10) Patent No.: US 9,352,922 B2
(45) Date of Patent: May 31, 2016

(54) WEB CONVEYING DEVICE, PRINTING APPARATUS, AND TENSION CONTROL METHOD

(75) Inventors: Kohji Kuwana, Ibaraki (JP); Masahiro Mizuno, Ibaraki (JP)

(73) Assignee: RICOH COMPANY, LTD., Tokyo (JP)

( * ) Notice: Subject to any disclaimer, the term of this patent is extended or adjusted under 35 U.S.C. 154(b) by 930 days.

(21) Appl. No.: 13/618,196

(22) Filed: Sep. 14, 2012

(65) Prior Publication Data

US 2013/0068814 A1 Mar. 21, 2013

(30) Foreign Application Priority Data

Sep. 19, 2011 (JP) ..... 2011-203916
May 31, 2012 (JP) ..... 2012-125339

(51) Int. Cl.
*B65H 23/04* (2006.01)
*B65H 23/188* (2006.01)

(52) U.S. Cl.
CPC ..... *B65H 23/1888* (2013.01); *B65H 2403/514* (2013.01); *B65H 2801/03* (2013.01)

(58) Field of Classification Search
CPC ..... B65H 23/044; B65H 23/1888
USPC ..... 400/101, 102
See application file for complete search history.

(56) References Cited

U.S. PATENT DOCUMENTS 6,592,276 B2 * 7/2003 Ohba ..... B41J 15/16 101/484
6,969,206 B2 * 11/2005 Iwanaga ..... B65H 23/1888 226/185
2001/0024589 A1 9/2001 Ohba et al.
2003/0177923 A1 9/2003 Iwanaga et al.

FOREIGN PATENT DOCUMENTS

| | | |
|---|---|---|
| JP | 2001-335206 | 12/2001 |
| JP | 2003-327356 | 11/2003 |
| JP | 2004-182457 | 7/2004 |
| JP | 2004-250203 | 9/2004 |
| JP | 2005-001858 | 1/2005 |
| JP | 2006-248722 | 9/2006 |
| JP | 2007-055791 | 3/2007 |
| JP | 2011-046489 | 3/2011 |

* cited by examiner

*Primary Examiner* — Michael McCullough
(74) *Attorney, Agent, or Firm* — Oblon, McClelland, Maier & Neustadt, L.L.P

(57) ABSTRACT

A control unit allows a rotational position of a tension generating roller to be changed depending on a width of a web at time of the beginning of conveyance of the web, controls a motor according to a detection signal of a second sensor such that a tension guide maintains its position within a predetermined range during conveyance of the web, causes position data at time of keeping the same value of the position data of the motor for a predetermined period to be stored, calculates an initial operational position of the tension generating roller using the position data and a predetermined correction coefficient, and sets the calculated initial operational position as an initial operational position of the tension generating roller at time of the beginning of next conveyance of web.

17 Claims, 7 Drawing Sheets

WEB CONVEYING DEVICE, PRINTING APPARATUS, AND TENSION CONTROL METHOD

CROSS-REFERENCE TO RELATED APPLICATIONS

The present application claims priority to and incorporates by reference the entire contents of Japanese Patent Application No. 2011-203916 filed in Japan on Sep. 19, 2011 and Japanese Patent Application No. 2012-125339 filed in Japan on May 31, 2012.

BACKGROUND OF THE INVENTION

1. Field of the Invention

The present invention relates to a web conveying device, a printing apparatus, and a tension control method.

2. Description of the Related Art

In a printing apparatus for forming an image on a web (rolled sheet), there is a known technique for conveying a web having no feed hole by a roller conveyance mechanism to form an image on the web.

When a web does not have feed holes, accurate conveyance of the web to an image forming unit becomes more difficult as printing speed increases. For example, Japanese Patent Application Laid-open No. 2001-335206 discloses a technique to deal with such a situation.

Moreover, when a web does not have feed holes, a conveyance load at the time of the beginning of web conveyance fluctuates sharply as printing speed increases. Since such fluctuation in the conveyance load causes web conveyance speed to fluctuate, an image forming failure occurs when an image is formed on the web. For example, Japanese Patent Application Laid-open No. 2003-327356 discloses a technique for reducing image forming failures by suppressing fluctuation in the web conveyance speed by changing tension to be imparted to a web.

Moreover, a load applied to a web varies depending on the width of the web to be used. When a load applied to a web is small at the time of the beginning of web conveyance, application of a load in a direction other than a web conveyance direction deteriorates directionality of web conveyance, causing skew of the web and deterioration of printing quality. In addition, a conveyance load at the time of normal travelling increases as a width of a web to be used increases. Consequently, when a web has a wider width, a conveyance load fluctuates sharply, and thus an image forming failure is likely to occur.

For example, Japanese Patent Application Laid-open No. 2004-182457 discloses a technique in which a rotational position of a tension generating roller at the time of the beginning of web conveyance is determined by width and ream weight of a web to suppress fluctuation at the time of the beginning of web conveyance, so that travelling failures and image forming failures are reduced.

In addition, for example, Japanese Patent Application Laid-open No. 2006-248722 discloses a technique for imparting appropriate tension to a web to be conveyed when the web has a difficulty in receiving tension. According to the technique, the appropriate tension is imparted by a tension generating roller and a tension adjusting guide that operates separately from the tension generating roller.

Moreover, for example, Japanese Patent Application Laid-open No. 2004-250203 discloses a technique used in a web tension-applying device of a printing apparatus. In the web tension-applying device including a web tension changing unit for changing tension of a web by drums sandwiching the web and a pressing force of a pressing roller, and a buffer mechanism for visually checking strength of the web tension, the drums of the web tension changing unit and the buffer mechanism are integrally provided.

Moreover, in a case where tension is imparted to a web, appropriate tension data that satisfies conditions such as width, ream weight, smoothness, and water content rate of the web needs to be prepared for each web. However, such data preparation for each web causes an increase in data volume. For example, Japanese Patent Application Laid-open No. 2011-046489 discloses a technique for determining web conveyance resistance. According to the technique, a tension generating roller is rotated and fixed in a predetermined rotational position, and a position of a tension arm is detected, so that the web conveyance resistance is determined based on the detected positional information.

However, even when a rotational position of a tension generating roller at the time of the beginning of web conveyance is determined by width and ream weight of a web as similar to the above-described conventional technique, tension at the time of the beginning of web conveyance cannot be constant due to influence exerted by web variations and web changes. The web variations include a variation of web material or web glossiness and surface treatment in pre-printing. The web changes include a change in web surface smoothness due to print conditions such as duplex printing, and a change in a web state due to duplex printing.

Moreover, after a new type of web is printed, an operator needs to determine whether tension at the beginning of web conveyance is appropriate, and sets the appropriate tension at the time of printing the new type of web next time to start printing. This requires extra labor.

In addition, there are cases where appropriate tension is not set, for example, an operator has forgotten to set appropriate tension. If tension greater than target tension has been set, an images forming failure occurs. If tension less than target tension has been set, on the other hand, a trouble such as skew occurs due to reduction in web conveyance stability.

Moreover, in a case where short-time printing is repeatedly performed when tension is less than or greater than target tension, printing ends without knowing appropriate tension.

In addition, in a case where a tension generating roller is fixed to a predetermined rotational position, and web conveyance resistance is determined, web conveyance resistance determined using conveyance speed different from process speed such as automatic loading control and manual conveyance control may not be the most appropriate conveyance resistance for the process speed.

Moreover, in a case where a tension generating roller is fixed to a predetermined rotational position in the course of web conveyance at process speed, a trouble such as skew occurs due to reduction in web conveyance stability.

Therefore, there is a need for a web conveying device, a printing apparatus, and a tension control method that are capable of providing tension at the time of the beginning of web conveyance as appropriate tension.

SUMMARY OF THE INVENTION

According to an embodiment, there is provided a web conveying device that includes: a conveying mechanism, a tension generating mechanism, and a control unit. The conveying mechanism is configured to convey a web. The tension generating mechanism is configured to impart tension to the web fed to the conveying mechanism. The tension generating mechanism includes: a tension generating roller configured to be rotationally driven by a motor about a rotation shaft eccentrically positioned; a first sensor configured to detect a rotational position of the tension generating roller; a pressing roller configured to press the web to the tension generating roller; a tension guide configured to rotate according to degree of tension generated on the web by the tension generating roller and the pressing roller; and a second sensor configured to detect a rotational position of the tension guide. The control unit is configured to control the rotational position of the tension generating roller by controlling the motor according to detection signals of the first sensor and the second sensor. The control unit causes the rotational position of the tension generating roller to be changed depending on a width of the web at time of the beginning of conveyance of the web, controls the motor according to the detection signal of the second sensor such that the tension guide maintains its position within a predetermined range during conveyance of the web, causes last position data in a period in which position data of the motor continuously changes to be stored, calculates an initial operational position of the tension generating roller using the last position data and a predetermined correction coefficient, and sets the calculated initial operational position as an initial operational position of the tension generating roller at time of the beginning of next conveyance of the web.

According to another embodiment, there is provided a web conveying device that includes a conveying mechanism, a tension generating mechanism, and a control unit. The conveying mechanism is configured to impart tension to the web fed to the conveying mechanism. The tension generating mechanism includes: a tension generating roller configured to be rotationally driven by a motor about a rotation shaft eccentrically positioned; a first sensor configured to detect a rotational position of the tension generating roller; a pressing roller configured to press the web to the tension generating roller; a tension guide configured to rotate according to degree of tension generated on the web by the tension generating roller and the pressing roller; and a second sensor configured to detect a rotational position of the tension guide. The control unit is configured to control the rotational position of the tension generating roller by controlling the motor according to detection signals of the first sensor and the second sensor. The control unit causes the rotational position of the tension generating roller to be changed depending on a width of the web at time of the beginning of conveyance of the web, controls the motor according to the detection signal of the second sensor such that the tension guide maintains its position within a predetermined range during conveyance of the web, causes position data at time of keeping the same value of the position data of the motor for a predetermined period to be stored, calculates an initial operational position of the tension generating roller using the position data and a predetermined correction coefficient, and sets the calculated initial operational position as an initial operational position of the tension generating roller at time of the beginning of next conveyance of the web.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

An embodiment of the present invention will be described in detail with reference to the accompanying drawings. In the following embodiment, a printing apparatus including an image forming mechanism (image forming unit) in addition to a web conveying mechanism is described. However, the embodiment may be similarly applied to a web conveying device provided with a web conveying mechanism without an image forming mechanism (image forming unit). The web conveying device is, for example, a web conveying device for conveying a web to a printing apparatus, a web conveying device for conveying a web inside a printing apparatus, and a web conveying device for conveying a web discharged from a printing apparatus. However, the web conveying device is not limited thereto. A web conveying device may be a device for simply conveying a web without relation with a printing apparatus.

Figure 1:
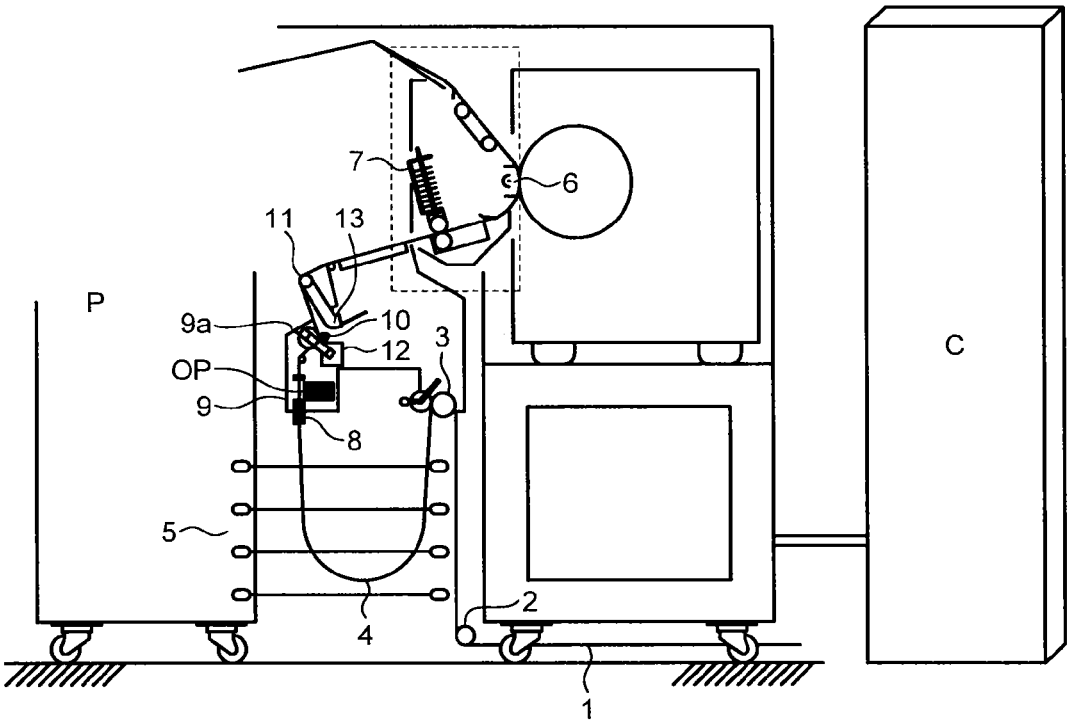
FIG. 1 is a schematic diagram illustrating an example of a printing apparatus according to the present embodiment.

FIG. 1 is a schematic diagram illustrating an example of a printing apparatus P of the present embodiment. As illustrated in FIG. 1, the printing apparatus P includes a guide roller 2, a web capturing roller 3, an air loop mechanism 4, an air buffer sensor 5, an image forming unit 6, a web conveying mechanism 7, a web edge guide 8, a tension generating mechanism 9, and a tension guide 11.

A web 1 is fed from a sheet feeding device (not illustrated) disposed in a front stage of the printing apparatus P, and passes a lower side of a housing of the printing apparatus P. Then, the web 1 is conveyed to the air loop mechanism 4 by the web capturing roller 3 through the guide roller 2. In the present embodiment, the web 1 is a sheet of paper, but is not limited thereto. For example, the web 1 may be a plastic film.

The air buffer sensor 5 detects an amount of slack of the web 1 in the air loop mechanism 4. In the present embodiment, the air buffer sensor 5 is provided with four optical sensors, but is not limited thereto. A slack amount of the web 1 in the air loop mechanism 4 is maintained constant by controlling speed of the web capturing roller 3 according to the slack amount detected by the air buffer sensor 5.

The image forming unit 6 records and forms an image on the web 1. The web conveying mechanism 7 conveys the web 1 to the image forming unit 6. The web edge guide 8 corrects skew of the web 1 in the vicinity of an inlet of the web conveying mechanism 7, and is disposed in a latter stage of the air loop mechanism 4. A position of the web 1 is corrected by a guide member having a conventional configuration.

Since the guide member is disclosed in, for example, Japanese Patent Application Laid-Open No. 2001-335206, a detailed description thereof is omitted. The tension generating mechanism 9 includes a tension generating roller 9*a*, and imparts suitable tension to the web 1 using the tension generating roller 9*a*. The web 1 with the imparted tension is conveyed to the image forming unit 6 through the tension guide 11.

Figure 2:
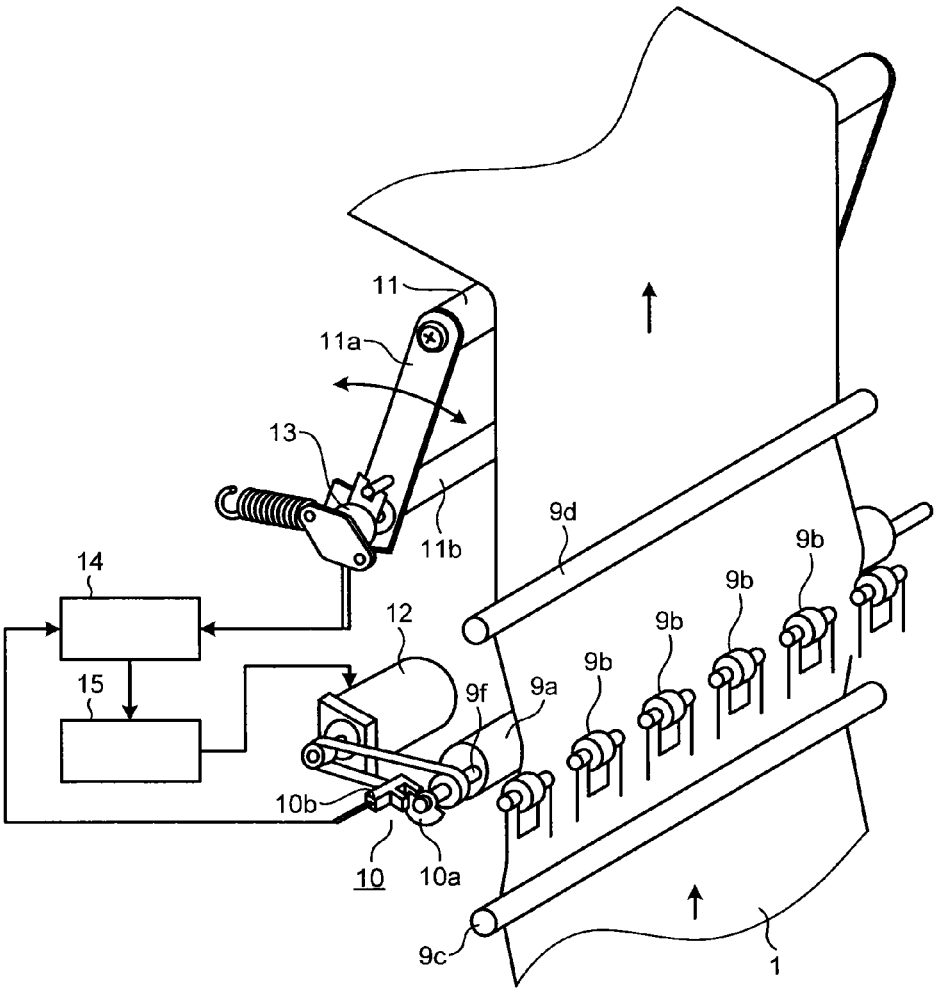
FIG. 2 is a diagram illustrating an example of a detailed configuration of a tension generating mechanism according to the present embodiment.
Figure 3:
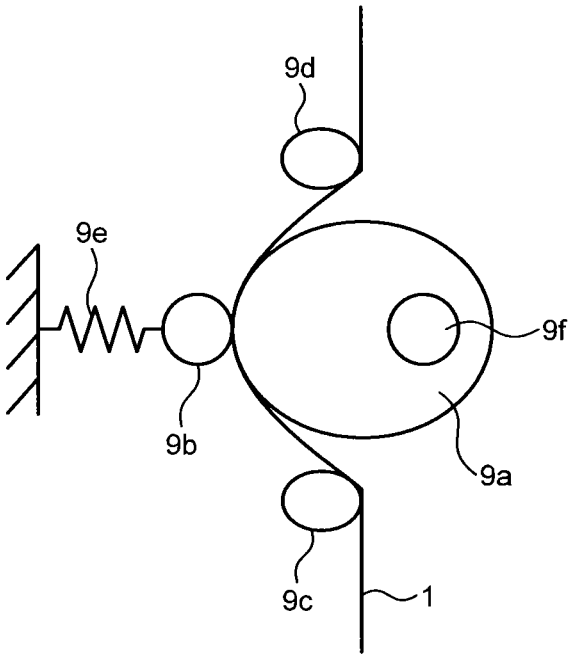
FIG. 3 is a diagram illustrating an example of operation of a tension generating roller according to the present embodiment.
Figure 4:
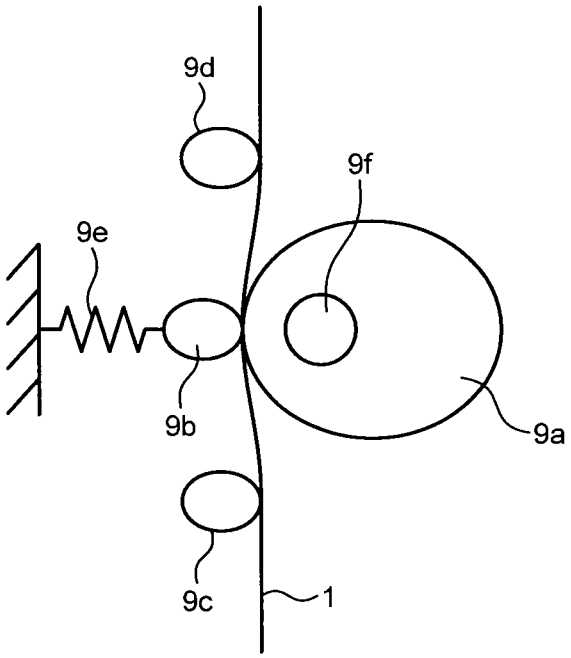
FIG. 4 is a diagram illustrating an example of operation of the tension generating roller according to the present embodiment.

FIG. 2 is a diagram illustrating an example of a detailed configuration of the tension generating mechanism 9 according to the present embodiment. FIG. 3 and FIG. 4 are diagrams each illustrating an example of operation of the tension generating roller 9*a*. As illustrated in FIG. 2 through FIG. 4, the tension generating mechanism 9 includes the tension generating roller 9*a*, a plurality of pressing rollers 9*b*, guide shafts 9*c* and 9*d*, a leaf spring 9*e*, a tension generating roller drive motor 12, a tension generating roller position detection sensor 10, the tension guide 11, a tension arm 11*a*, a shaft 11*b*, and an angle sensor 13.

The web 1 is guided by the guide shafts 9*c* and 9*d*, and travels in such a manner as to contact the tension generating roller 9*a*. The plurality of pressing rollers 9*b* is disposed opposite to the tension generating roller 9*a* on an opposite side of the web 1. These pressing rollers 9*b* allow the web 1 to be pressed toward the tension generating roller 9*a* side by the leaf spring 9*e*, thereby generating tension.

A rotation shaft 9*f* of the tension generating roller 9*a* is coupled with the tension generating roller drive motor 12. The tension generating roller 9*a* is rotated with rotation of the tension generating roller drive motor 12. As illustrated in FIG. 3, the rotation shaft 9*f* is provided in an eccentric position relative to the central axis of the tension generating roller 9*a*. Thus, when the rotation shaft 9*f* and the pressing rollers 9*b* have a positional relationship as illustrate in FIG. 3, tension to be imparted to the web 1 increases. When the rotation shaft 9*f* and the pressing rollers 9*b* have a positional relationship as illustrate in FIG. 4, tension to be imparted to the web 1 decreases.

The tension generating roller position detection sensor 10 detects a rotational position of the tension generating roller 9*a*. The tension generating roller position detection sensor 10 includes a semi-circular plate 10*a* and a member 10*b* that is disposed to sandwich the semi-circular plate 10*a*. Provided on one arm of the member 10*b* is a light emitting diode (not illustrated), whereas provided on the other arm is a light receiving element (not illustrated). Accordingly, the tension generating roller position detection sensor 10 detects a position of the tension generating roller 9*a* by detecting whether or not light is shielded by the semi-circular plate 10*a*.

This enables detection of whether the tension generating roller 9*a* is in a position illustrated in FIG. 3 or FIG. 4, and enables determination of whether the tension generating roller 9*a* is rotated in a direction in which the tension imparted to the web 1 increases or decreases. A configuration of this tension generating roller position detection sensor 10 is one example. The tension generating roller position detection sensor 10 may have another configuration.

A signal detected by the tension generating roller position detection sensor 10 is input to a print control device 14, and is used as a control signal for controlling the tension generating roller drive motor 12.

Upon passing the guide shaft 9*d*, the web 1 travels in contact with the tension guide 11. The tension guide 11 is attached to the tension arm 11*a*, and the tension arm 11*a* is rotatably supported around the shaft 11*b*. When the tension arm 11*a* rotates in a direction indicated by an arrow illustrated in FIG. 2, a rotation angle thereof is detected by the angle sensor 13. The angle sensor 13, for example, may have a configuration that allows a resistance value to change according to a rotation angle.

A detection signal of the angle sensor 13 is transmitted to the print control device 14, and is used as a control signal for controlling the tension generating roller drive motor 12 which drives the tension generating roller 9*a*.

An output signal of the print control device 14 is applied to the tension generating roller drive motor 12 such as a stepping motor through a driving circuit 15 of the tension generating roller drive motor 12.

Among the tension generating roller position detection sensor 10 and the angle sensor 13, the tension generating roller position detection sensor 10 is mainly used for control when sudden tension is generated to the web 1, for example, when printing begins. The angle sensor 13 is usually used to maintain a conveyance load constant, the conveyance load being applied to the web conveying mechanism 7.

Figure 5:
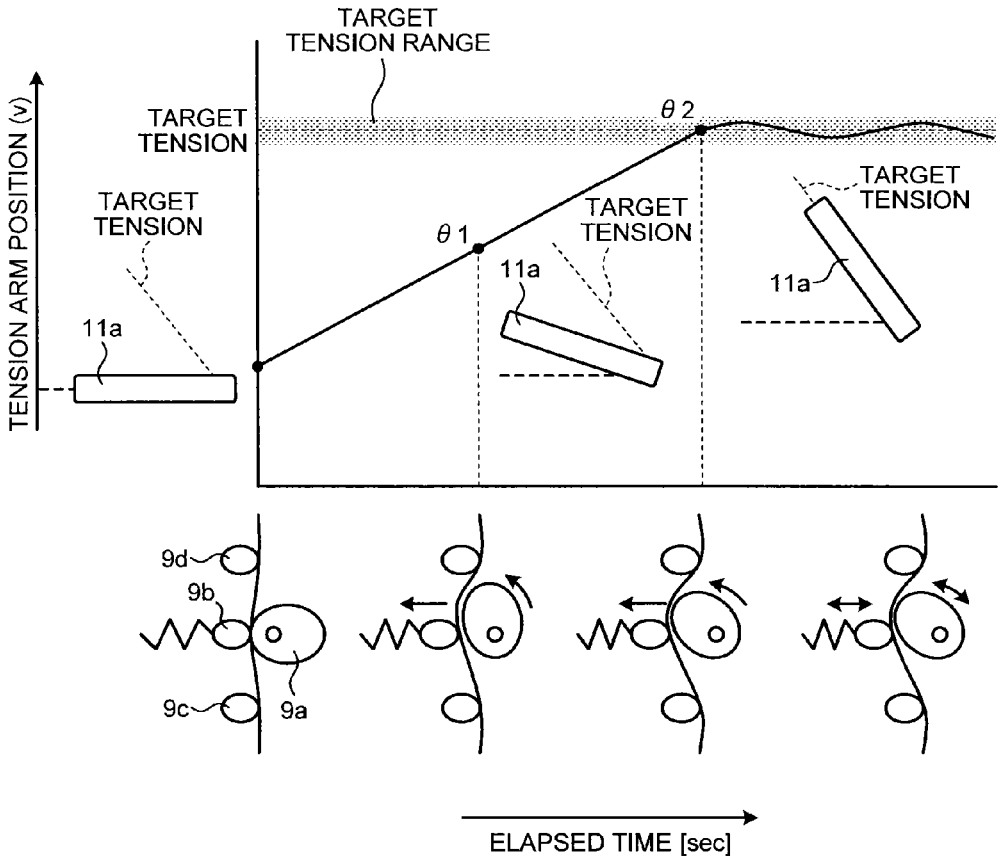
FIG. 5 is a diagram illustrating an example of a relationship between the rotational position of the tension generating roller and tension applied to a web.

FIG. 5 is a diagram illustrating an example of a relationship between the rotational position of the tension generating roller 9*a* and tension applied to the web 1.

The printing apparatus P has a function of allowing initial rotational position data Df of the tension generating roller 9*a* and target tension data, which are set as tension generating roller setting information according to width and ream weight of the web 1, to be set from an external input device such as a higher-level controller C and an operation panel OP prior to printing so that the printing apparatus P can deal with a wide variety of webs. Moreover, initial rotational position feedback data Ds of the tension generating roller 9*a* is transmitted to the printing apparatus P from the higher-level controller C, the initial rotational position feedback data Ds being for calculation in the printing apparatus P.

For example, when the web 1 is printed in the printing apparatus P for the first time, the higher-level controller C transmits the initial rotational position data Df, the target tension data, and the initial rotational position feedback data Ds as tension generating roller setting information of the web 1 to the printing apparatus P. In such a case, undefined information is set in the initial rotational position feedback data Ds.

In the present embodiment, since a load to be applied to the web 1 varies depending on the width of the web 1 to be used, the initial rotational position data Df is prepared as a data table. Rotational position data of the tension generating roller 9*a* capable of providing predetermined tension at the time of the beginning of web conveyance is determined in advance for each width of the web 1 based on an evaluation result and stores the data as the data table in a storage area (not illustrated) of the higher-level controller C. But, the initial rotational position data Df is not limited thereto. A calculation formula may be generated based on an evaluation result, and rotational position data of the tension generating roller 9*a* capable of providing predetermined tension at the time of the beginning of web conveyance may be calculated. In the present embodiment, the undefined information is a case where there is no data [0]. However, the undefined information is not limited thereto. A value of the undefined information may be out of the range of upper and lower limits of position of the tension generating roller 9*a*.

Upon beginning a print start operation upon print request, the print control device 14 causes the tension generating roller 9*a* to rotate for the predetermined number of times to move the tension generating roller 9*a* to a starting point so that slack of the web 1 on the tension generating roller 9*a* is removed. After the movement of the tension generating roller 9*a* to the starting point is completed, the print control device 14 causes the tension generating roller 9*a* to move to a predetermined rotational position θ1.

When the printing preparation is completed, at the same timing as the beginning of conveyance of the web 1, the print control device 14 usually sets a predetermined rotational position θ2 to a value of the initial rotational position feedback data Ds, and causes the tension generating roller 9*a* to move to the rotational position θ2. However, herein, since the undefined information is set in the initial rotational position feedback data Ds, the print control device 14 sets the predetermined rotational position θ2 to a value of the initial rotational position data Df, and causes the tension generating roller 9*a* to move to the rotational position θ2.

During conveyance of the web 1, a rotation angle of the tension arm 11*a* is detected by the angle sensor 13 to maintain target tension applied to the web 1. A detection signal of the tension arm 11*a* is transmitted to the print control device 14, the detection signal being detected by the angle sensor 13. Subsequently, a control signal of the tension generating roller drive motor 12 for driving the tension generating roller 9*a* is generated, the control signal being necessary to maintain the target tension applied to the web 1. The generated control signal is transmitted to the driving circuit 15 of the tension generating roller drive motor 12 of the tension generating roller 9*a*. Upon receipt of the control signal, the driving circuit 15 applies the control signal to the tension generating roller drive motor 12, and controls the tension generating roller 9*a*.

In the present embodiment, assume that the target tension has a tension during web conveyance of 800 g based on an evaluation result. However, the target tension of the present embodiment is not limited thereto.

The tension arm 11*a* slightly moves up and down due to influence exerted by an image printed on the web 1 or unevenness such as perforation on the web 1 even when rotational position data of the tension generating roller 9*a* is the same.

When the target tension is to be maintained, the slight up-and-down movement is detected by the angle sensor 13 to prevent the tension generating roller 9*a* from hunting, and a rotational position of the tension generating roller 9*a* within a target tension range is controlled to be maintained. In the present embodiment, the target tension range is assumed to be a predetermined range from a position of the tension arm 11*a* corresponding to the target tension.

When strong tension is provided, that is, when a position of the tension arm 11*a* exceeds by +2° relative to a control target position of the tension arm 11*a* capable of providing the tension during web conveyance of 800 g, an image forming failure occurs. On the other hand, weak tension is provided, that is, when the position of the tension arm 11*a* is below −2° relative to the control target position of the tension arm 11*a*, deterioration of web conveyance stability occurs. Therefore, in the present invention, the predetermined range is set to a ±2° range relative to the control target position of the tension arm 11*a* based on the evaluation result. However, the predetermined range of the present invention is not limited thereto.

Figure 6:
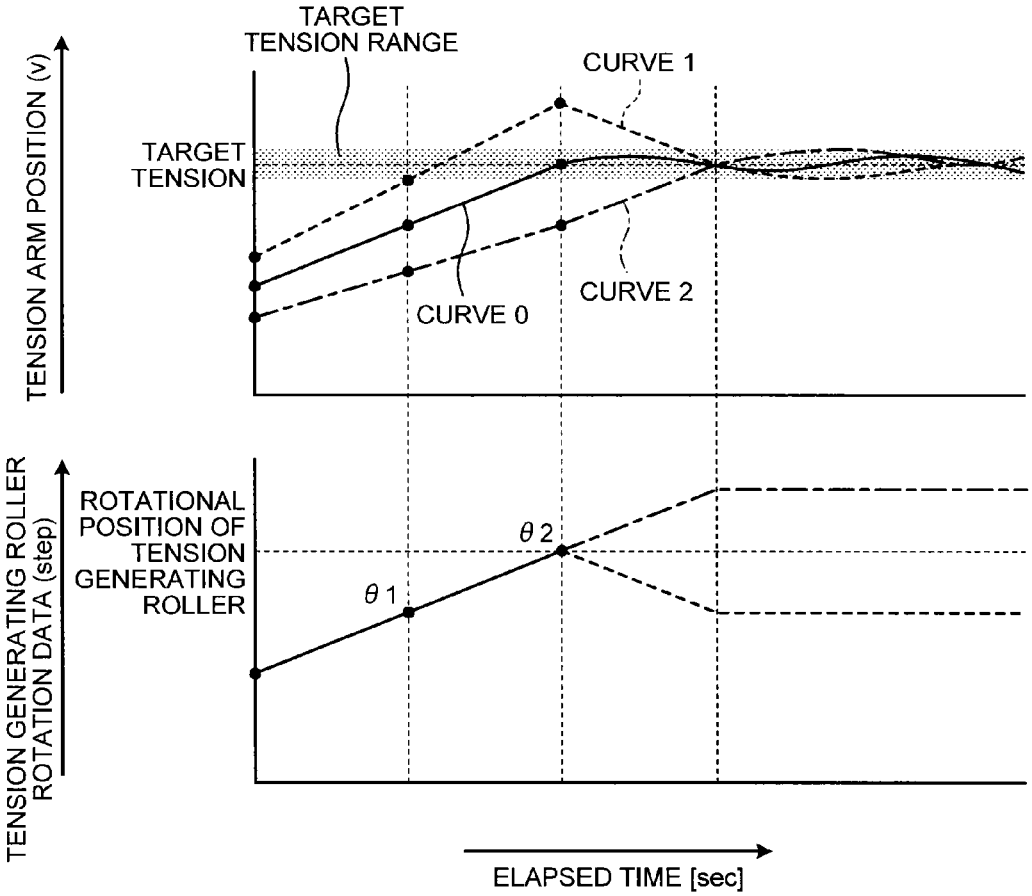
FIG. 6 is a diagram illustrating an example of a relationship between web smoothness and tension applied to the web.

FIG. 6 is a diagram illustrating an example of a relationship between smoothness of the web 1 and tension applied to the web 1. FIG. 6 illustrates a change in the tension applied to the web 1 when web conveyance begins at predetermined rotational positions θ1 and θ2 determined beforehand by width and ream weight of the web 1, and the tension arm 11*a* converges at target tension during web conveyance. Moreover, a curve 0 indicates a case where the web 1 has standard smoothness. A curve 1 indicates a case where the web 1 has the same width but low smoothness (unlikely to slide), whereas a curve 2 indicates a case where the web 1 has the same width but high smoothness (likely to slide). In each of FIG. 5 and FIG. 6, a horizontal axis indicates a time axis.

Even when the smoothness differs, the tension generating roller 9*a* is controlled by the print control device 14 during web conveyance such that the tension arm 11*a* converges within a target tension range.

The target tension, which is controlled during web conveyance, is the most suitable tension according to width and ream weight of the web 1 or state of smoothness and water content rate of the web 1, and a rotational position of the tension generating roller 9*a* at that time is stored as rotational position data used for application of the most suitable tension.

In a case where a print operation is performed on a continuous web, a state of the web (e.g., an outer circumferential side and a core side of rolled sheet) fed from a feeding device (not illustrated) changes over time. Moreover, in a case where a print operation is performed by tandem connection for duplex printing, a state of a web conveyed to a second device side by applying oil on a first device side changes over time.

Accordingly, the print control device 14 causes the rotational position data of the tension generating roller 9*a* to be stored at a control cycle during web conveyance. The print control device 14 then sets last rotational position data D of the tension generating roller 9*a* during web conveyance as rotational position calculation data De of the tension generating roller 9*a* at the time of the beginning of web conveyance next time.

In the present embodiment, the control cycle is a 260 ms cycle according to a sensor capturing cycle. However, the control cycle of the present embodiment is not limited thereto.

Figure 7:
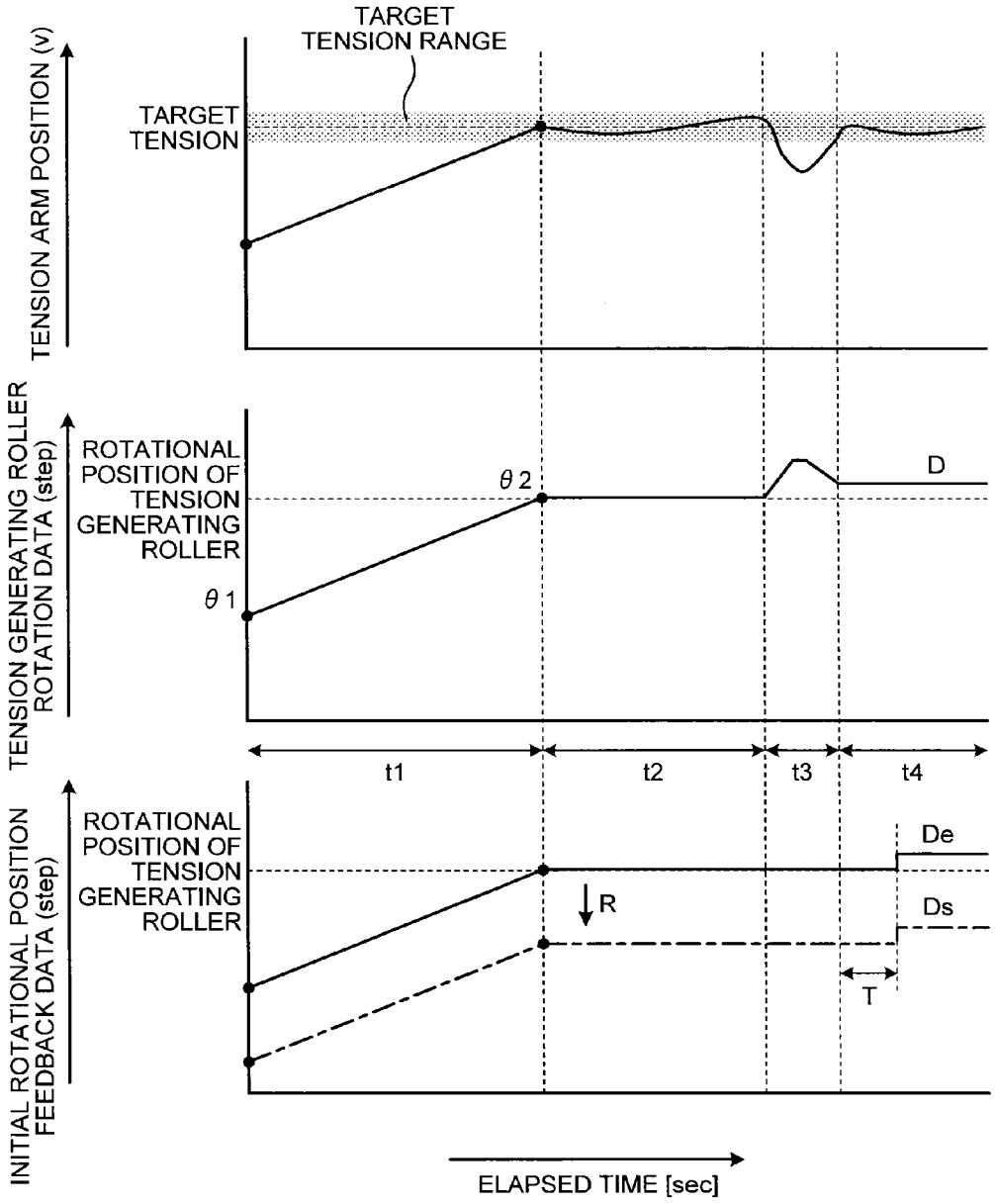
FIG. 7 is a diagram illustrating an example of changes in web tension during web conveyance.

FIG. 7 is a diagram illustrating an example of changes in web tension during web conveyance.

In FIG. 7, assume that t1 is a period from the beginning of web conveyance to convergence at target tension, each of t2 and t4 is a period in which the tension arm 11*a* is being controlled within a target tension range during web conveyance. Assume that t3 is a period in which the web 1, whose portion stopped at a fixing conveyance unit of the first device side in a print operation with tandem connection is deformed by influence of heat, passes the tension guide 11 of the second device side. Or alternatively, t3 is a period in which a page on which tension is locally changed by influence such as a print pattern passes the tension guide 11 of the second device side.

First, in a state that convergence of target tension has not been made since web conveyance begins, the rotational position data D indicates that tension is not kept constant for a predetermined period T. Therefore, such a period T is determined to be a period t1. In this period (period t1), the last rotational position data D of the tension generating roller 9*a* during web conveyance is set as the rotational position calculation data De.

Next, when convergence of the target tension is made, and the rotational position data D of the tension generating roller 9*a* indicates that tension is kept constant for a predetermined period T, such a period T is determined to be a period t2. In this period, if the rotational position data D of the tension generating roller 9*a* indicates that the tension generating roller 9*a* is kept at the same position for a predetermined period T during web conveyance, such data is set as the rotational position calculation data De, and a value of the rotational position calculation data De is continuously updated whenever a value of the data changes.

In the present embodiment, the predetermined period T is set to 1.3 sec corresponding to duration of tension control cycle (260 ms) for five times based on an evaluation result. However, the predetermined period T of the present embodiment is not limited thereto.

Moreover, even after the period t2, the period t3 in which tension locally changes can be generated. However, since the tension changes in the period t3, the tension cannot be continuously constant in the predetermined period T. Consequently, a value of the rotational position data D does not also become constant, so that the last rotational position calculation data De of the tension generating roller 9*a* during web conveyance is not updated, thereby storing the rotational position calculation data De last updated in the period t2.

Moreover, after the period t2 in which convergence of the rotational position of the tension generating roller 9*a* is made, if the rotational position data D of the tension generating roller 9*a* indicates that the tension generating roller 9*a* is kept at the same position for a predetermined period T, the last rotational position calculation data De of the tension generating roller 9*a* during web conveyance is updated.

The predetermined period T is determined based on a result of a measurement actually made in advance.

The print control device 14 calculates the initial rotational position feedback data Ds from the rotational position calculation data De obtained accordingly.

The last rotational position calculation data De of the tension generating roller 9*a* during web conveyance, which is controlled such that the tension arm 11*a* converges within a target tension range, is rotational position data generated in a dynamic state. Consequently, if the rotational position calculation data De is set as the initial rotational position feedback data Ds of the tension generating roller 9*a* being in a static state prior to the beginning of web conveyance, exertion of tension is not always the same.

Therefore, when the last rotational position calculation data De of the tension generating roller 9*a* during web conveyance, which is controlled such that the tension arm 11*a* converges within a target tension range, is used as the initial rotational position feedback data Ds of the tension generating roller 9*a* prior to the beginning of web conveyance next time, a correction needs to be made using a predetermined correction coefficient R. The predetermined correction coefficient R is correction rotational position data to use the rotational position data generated in the dynamic state in the static state, and is appropriately determined by making trials (e.g., deviations of rotational positions in a dynamic state and a static state are collected a plurality of times, and an average value thereof is used) in advance.

The predetermined correction coefficient R is such rotation data of the tension generating roller 9*a* as to reduce tension by 300 g from target tension. In the present embodiment, the predetermined correction coefficient R is set to 72 (step) based on an evaluation result. However, the predetermined correction coefficient R of the present embodiment is not limited thereto.

First, the print control device 14 determines a tension arm position Ps serving as target tension at the time of the beginning of web conveyance from a tension arm position Pp serving as target tension during web conveyance and the predetermined correction coefficient R (see expression (1)).

$$Ps=Pp+R \tag{1}$$

Subsequently, the print control device 14 determines a difference between the current tension arm position Pn detected by the angle sensor 13 during web conveyance and the tension arm position Ps serving as target tension at the time of the beginning of web conveyance, and calculates rotation data Dm of the tension generating roller 9*a*, which is allowing the tension arm 11*a* to shift from the tension arm position Pn to the tension arm position Ps, by using a conversion coefficient CN (see mathematical formula (2)). The conversion coefficient CN is a weighted rate of change (unit: g/1°) based on an angle of the tension arm 11*a*, and is appropriately determined depending on the configuration of the tension generating mechanism 9.

The conversion coefficient CN is changeable weighted data per step. In the present embodiment, the conversion coefficient CN is set to 40 g/step based on an evaluation result. However, the conversion coefficient CN of the present embodiment is not limited thereto.

$$Dm=(Pn-Ps)\times CN \tag{2}$$

Subsequently, the print control device 14 calculates a value of the initial rotational position feedback data Ds of the tension generating roller 9*a* corresponding to the tension arm position Ps serving as target tension at the time of the beginning of web conveyance by subtracting a value of the rotation data Dm of the tension generating roller 9*a* allowing a shift from Pn to Ps from a value of the last rotational position calculation data De of the tension generating roller 9*a* during web conveyance (see mathematical expression (3)).

$$Ds=De-Dm \tag{3}$$

The print control device 14 transmits the initial rotational position feedback data Ds thus calculated to the higher-level controller C, and causes the initial rotational position feedback data Ds and web information to be backed up inside the higher-level controller C as tension generating roller setting information. When a print operation is performed on a similar type of web 1 next time, the print control device 14 reloads the calculated initial rotational position feedback data Ds of the tension generating roller 9*a* and the web information from the higher-level controller C, and feeds back to the predetermined rotational positions θ2 and θ1. More specifically, the print control device 14 sets the predetermined rotational position θ2 to a value of the initial rotational position feedback data Ds of the tension generating roller 9*a*. Moreover, a value obtained by subtracting a value of predetermined rotation data α from a value of the predetermined rotational position θ2 becomes the predetermined rotational position θ1. The predetermined rotation data α is rotation data in the case of rotating from the predetermined rotational positions θ1 to θ2, and is appropriately determined by performing trials for behavior at the time of the beginning of web conveyance (e.g., to check changes in quality in test printing) in advance.

The predetermined rotation data α is rotation data of the tension generating roller 9*a*. In the present embodiment, the predetermined rotation data α is set to 67 (step) based on an evaluation result, but is not limited thereto.

$$\theta 1=\theta 2-\alpha \tag{4}$$

However, in a case where a calculation result for θ1 is less than zero (minus data), zero which is a lower limit of θ1 is set again.

In a case where initial tension at the time of the beginning of web conveyance is greater than target tension during web conveyance, the predetermined correction coefficient R is set to such a correction value as to allow inclination of the tension arm 11*a* toward a direction in which tension is reduced. In a case where initial tension at the time of the beginning of web conveyance is less than target tension during web conveyance, the predetermined correction coefficient R is set to such a correction value as to allow inclination of the tension arm 11*a* toward a direction in which tension is increased.

Therefore, not only an operator can save labor of setting appropriate tension, but also the most suitable tension can be set from the time of start-up for the first printing, thereby providing the maximum effect.

However, in a case where a value of the calculated initial rotational position feedback data Ds of the tension generating roller 9*a* is not within a range in which the tension generating roller 9*a* can apply appropriate tension, the print control device 14 resets the calculated initial rotational position feedback data Ds of the tension generating roller 9*a* based on upper and lower limit position data of the tension generating roller 9*a*, which is determined in advance.

The upper and lower limit position data determined in advance of the tension generating roller 9*a* indicates a control range of a tension roller in which the tension generating roller 9*a* can apply appropriate tension to the web. In the present embodiment, the control range is between 9° (20-step) and 171° (380-step) with a lower limit of 9° (20-step) and an upper limit of 171° (380-step). However, the upper and lower limit position data is not limited thereto.

In a case where the initial rotational position feedback data Ds of the tension generating roller 9*a* is calculated based on the result of a measurement actually made in advance without setting the predetermined correction coefficient R, initial tension at the time of the beginning of web conveyance tends to be greater than target tension during web conveyance.

A conveyance method of the web 1 ideally allows the tension arm 11*a* to converge within a target tension range subsequent to web conveyance by setting target tension prior to web conveyance to be slightly less than a target tension range in the course of web conveyance. Accordingly, the print control device 14 can further enhance the effects by setting the predetermined correction coefficient R to such a correction value as to allow inclination of the tension arm 11*a* toward a direction in which tension is reduced.

Such a correction value as to allow inclination of the tension arm 11*a* in a direction in which tension is reduced is a value of the rotation data α of the tension generating roller 9*a*. In the present embodiment, the correction value is added to the predetermined correction coefficient R, thereby providing data capable of reducing the tension. However, the correction value of the present embodiment is not limited thereto.

Figure 8:
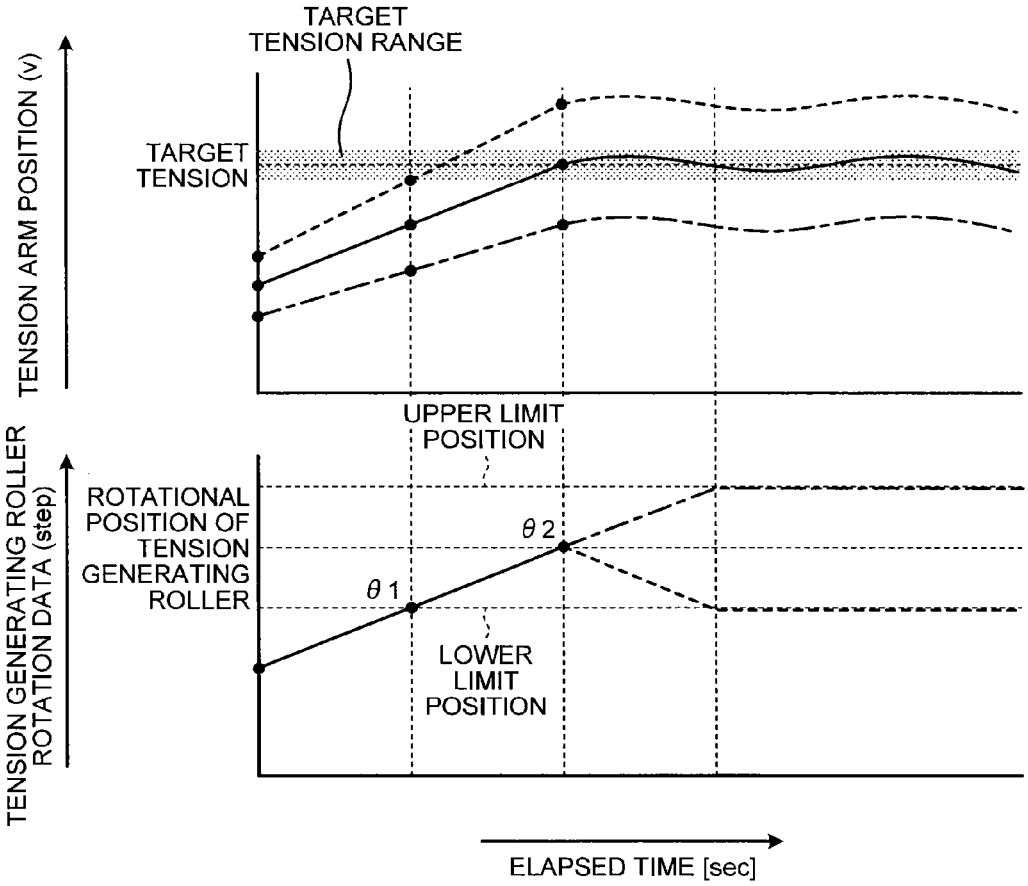
FIG. 8 is a diagram illustrating an example of operation when the rotational position of the tension generating roller reaches upper and lower limits.

FIG. 8 is a diagram illustrating an example of operation when the rotational position of the tension generating roller 9*a* reaches upper and lower limits. As illustrated in FIG. 8, there are cases where the tension arm 11*a* does not converge at target tension due to a type of web even when the rotational position of the tension generating roller 9*a* reaches upper and lower limits thereof.

In such cases, the tension arm 11*a* can be in a convergence state even when the tension arm 11*a* does not reach the target tension while the rotation data of the tension generating roller 9*a* remains at the upper and lower limits. Therefore, the print control device 14 calculates the initial rotational position feedback data Ds of the tension generating roller 9*a* using rotational position data D, which is provided when rotational position of the tension generating roller 9*a* remains the same position for a predetermined period, as the last rotational position calculation data De of the tension generating roller 9*a* during web conveyance.

The print control device 14 is configured to be able to select whether to clear or not to clear the calculated initial rotational position feedback data Ds of the tension generating roller 9*a* when the web 1 is determined to be replaced such as a case where the web 1 no longer exists in the conveying device and a case where a width of the web 1 changes, when tension generating roller setting information is changed in response to an input from an external input device such as the higher-level controller C and the operation panel OP, or when the printing apparatus P is powered off. Since a load of the web 1 varies due to external factors such as storage conditions of the web 1 and operating environment in spite of the same type of web 1, such a selection can be made. In addition, the print control device 14 can change the predetermined time T and the predetermined correction coefficient R in response to an input from the external input device such as the higher-level controller C and the operation panel OP.

According to the present embodiment, therefore, in a period in which position data of a motor continuously changes, last position data of the motor for rotationally driving a tension generating roller is stored, an initial operational position of the tension generating roller is calculated based on the stored position data and a predetermined correction coefficient, and the calculated initial operational position is set as an initial operational position of the tension generating roller at the time of beginning of web conveyance next time. According to the present embodiment, therefore, when tension is greater than or less than target tension, or when short-time printing is repeated, the tension at the time of the beginning of web conveyance can be appropriate tension.

Moreover, in the present embodiment, position data of a motor for rotationally driving a tension generating roller at the time of keeping the same value of the position data of the motor for a predetermined period is stored, an initial operational position of the tension generating roller is calculated from the stored position data and a predetermined correction coefficient, and the calculated initial operational position of the tension generating roller is set as an initial operational position of the tension generating roller at the time of the beginning of web conveyance next time. According to the present embodiment, therefore, the tension at the time of the beginning of web conveyance can be constant, thereby suppressing an image forming failure caused by tension set greater than target tension, and a trouble such as skew caused by deterioration of web conveyance stability due to tension set less than target tension.

According to the present invention, tension at the time of the beginning of web conveyance can be provided as appropriate tension.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A web conveying device comprising:

a conveying mechanism to convey a web;

a tension generating mechanism to impart tension to the web fed to the conveying mechanism, the tension generating mechanism including:

a tension generating roller to be rotationally driven by a motor about a rotation shaft eccentrically positioned;

a first sensor to detect a rotational position of the tension generating roller;

a pressing roller to press the web to the tension generating roller;

a tension guide to rotate according to degree of tension generated on the web by the tension generating roller and the pressing roller; and a second sensor to detect a rotational position of the tension guide; and a controller configured to control the rotational position of the tension generating roller by controlling the motor according to detection signals of the first sensor and the second sensor, wherein the controller causes the rotational position of the tension generating roller to be changed depending on a width of the web at time of the beginning of conveyance of the web, controls the motor according to the detection signal of the second sensor such that the tension guide maintains its position within a predetermined range during conveyance of the web, causes last position data in a period in which position data of the motor continuously changes to be stored, calculates an initial operational position of the tension generating roller using the last position data and a predetermined correction coefficient, and sets the calculated initial operational position as an initial operational position of the tension generating roller at time of the beginning of next conveyance of the web.

2. The web conveying device according to claim 1, wherein, when the calculated initial operational position is not within a range in which the tension generating roller is able to apply appropriate tension, the controller sets the initial operational position of the tension generating roller at the time of the beginning of next conveyance of the web based on upper and lower limits of position of the tension generating roller.

3. The web conveying device according to claim 1, wherein the controller sets the predetermined correction coefficient to such a value as to reduce the tension, such that the initial operational position of the tension generating roller at the time of the beginning of next conveyance of the web is below the predetermined range of the tension guide during conveyance of the web.

4. The web conveying device according to claim 1, wherein, when the web is replaced, when initial tension data of the tension generating roller is changed, when target tension data of the tension generating roller is changed, or when power of an apparatus provided with the web conveying device is switched off, the controller clears the initial operational position of the tension generating roller at the time of the beginning of next conveyance of the web.

5. The web conveying device according to claim 1, wherein the controller sets or changes the predetermined period based on an input from an external unit.

6. The web conveying device according to claim 1, wherein the controller sets or changes the predetermined correction coefficient based on an input from an external unit.

7. A printing apparatus comprising:

the web conveying device according to claim 1; and an image forming unit to form an image on the web.

8. A web conveying device comprising:

a conveying mechanism to convey a web;

a tension generating mechanism to impart tension to the web fed to the conveying mechanism, the tension generating mechanism including:

a tension generating roller to be rotationally driven by a motor about a rotation shaft eccentrically positioned;

a first sensor to detect a rotational position of the tension generating roller;

a pressing roller to press the web to the tension generating roller;

a tension guide to rotate according to degree of tension generated on the web by the tension generating roller and the pressing roller; and a second sensor to detect a rotational position of the tension guide; and a controller configured to control the rotational position of the tension generating roller by controlling the motor according to detection signals of the first sensor and the second sensor, wherein the controller causes the rotational position of the tension generating roller to be changed depending on a width of the web at time of the beginning of conveyance of the web, controls the motor according to the detection signal of the second sensor such that the tension guide maintains its position within a predetermined range during conveyance of the web, causes position data at time of keeping the same value of the position data of the motor for a predetermined period to be stored, calculates an initial operational position of the tension generating roller using the position data and a predetermined correction coefficient, and sets the calculated initial operational position as an initial operational position of the tension generating roller at time of the beginning of next conveyance of the web.

9. The web conveying device according to claim 8, wherein, when the calculated initial operational position is not within a range in which the tension generating roller is able to apply appropriate tension, the controller sets the initial operational position of the tension generating roller at the time of the beginning of next conveyance of the web based on upper and lower limits of position of the tension generating roller.

10. The web conveying device according to claim 8, wherein the controller sets the predetermined correction coefficient to such a value as to reduce the tension, such that the initial operational position of the tension generating roller at the time of the beginning of next conveyance of the web is below the predetermined range of the tension guide during conveyance of the web.

11. The web conveying device according to claim 8, wherein, when the tension guide converges at an outside of the predetermined range during conveyance of the web while the position data of the motor remains at the upper and lower limits, the controller sets the position data of the motor at the time of convergence of the tension guide at the outside of the predetermined range as an initial operational position of the tension generating roller at the time of the beginning of next conveyance of the web.

12. The web conveying device according to claim 8, wherein, when the web is replaced, when initial tension data of the tension generating roller is changed, when target tension data of the tension generating roller is changed, or when power of an apparatus provided with the web conveying device is switched off, the controller clears the initial operational position of the tension generating roller at the time of the beginning of next conveyance of the web.

13. The web conveying device according to claim 8, wherein the controller sets or changes the predetermined period based on an input from an external unit.

14. The web conveying device according to claim 8, wherein the controller sets or changes the predetermined correction coefficient based on an input from an external unit.

15. A printing apparatus comprising:

the web conveying device according to claim 8; and an image forming unit to form an image on the web.

16. A tension control method for a device that includes:

a conveying mechanism to conveying a web;

a tension generating mechanism to impart tension to the web fed to the conveying mechanism, the tension generating mechanism including:

a tension generating roller to be rotationally driven by a motor about a rotation shaft eccentrically positioned;

a first sensor to detect a rotational position of the tension generating roller;

a pressing roller to press the web to the tension generating roller;

a tension guide to rotate according to degree of tension generated on the web by the tension generating roller and the pressing roller; and a second sensor to detect a rotational position of the tension guide; and a controller configured to control the rotational position of the tension generating roller by controlling the motor according to detection signals of the first sensor and the second sensor, the tension control method comprising:

causing the rotational position of the tension generating roller to be changed depending on a width of the web at time of the beginning of conveyance of the web;

controlling the motor according to the detection signal of the second sensor such that the tension guide maintains its position within a predetermined range during conveyance of the web;

causing last position data in a period in which the position data of the motor continuously changes to be stored, calculating an initial operational position of the tension generating roller using the last position data and a predetermined correction coefficient; and setting the calculated initial operational position as an initial operational position of the tension generating roller at time of the beginning of next conveyance of the web.

17. The tension control method according to claim 16, wherein the device further includes an image forming unit to form an image on the web.

* * * * *